United States Patent [19]

Jasper, Jr.

[11] Patent Number: 4,858,511

[45] Date of Patent: Aug. 22, 1989

[54] SUPERCONDUCTIVE LEVITATED ARMATURES FOR ELECTROMAGNETIC LAUNCHERS

[75] Inventor: Louis J. Jasper, Jr., Ocean, N.J.

[73] Assignee: The United States of America as represented by the Secretary of the Army, Washington, D.C.

[21] Appl. No.: 167,653

[22] Filed: Mar. 14, 1988

[51] Int. Cl.[4] ..... F41F 1/02

[52] U.S. Cl. ..... 89/8; 102/517; 102/436; 124/3; 505/903

[58] Field of Search ..... 89/8; 102/436, 501, 102/517; 124/3; 505/876, 884, 902, 903, 904, 905, 907

[56] References Cited

U.S. PATENT DOCUMENTS 3,589,300 6/1971 Wipf ..... 89/8

OTHER PUBLICATIONS

New York Times, Mar. 20, 87, "Discoveries Bring a 'Woodstock' for Physics".

Electronics, Apr. 2, 87, "Superconductivity Drive Gets Hotter Every Day", pp. 49–51.

Physics Today, Apr. '87, "Superconductivity Seen Above The Boiling Point Of Nitrogen", pp. 17–23.

Physical Review Letters, pp. 1676–1679, Apr. 20, 1987, vol. 58, No. 16.

Physical Review Letters, pp. 2684–2686, 22 Jun. 1987, vol. 58, No. 25.

Longsworth et al., "Fast Cooldown J-T Refrigerators for IR Detectors" 4th International Cryocooler Conference, Sept. 1986, pp. 1–13.

Air Products product catalog 1980.

*Primary Examiner*—Stephen C. Bentley

*Attorney, Agent, or Firm*—Michael J. Zelenka; Ann M. Knab

[57] ABSTRACT

An electromagnetic railgun launcher and armature. The armature is made from superconducting material and is levitated between the rails of the launcher by the Meissner effect. The Meissner effect is created by cooling the armature and subjecting it to a magnetic field. The armature configuration has a closed loop topology and defines two planes - one plane coincides with the plane of the rails; the other plane is oblique to the first. The armature configuration, when placed between the rails receives an unbalanced Lorentz force which accelerates the armature.

4 Claims, 3 Drawing Sheets

SUPERCONDUCTIVE LEVITATED ARMATURES FOR ELECTROMAGNETIC LAUNCHERS

The invention described herein may be manufactured, used, and licensed by or for the Government for governmental purposes without the payment of any royalties thereon or therefor.

TECHNICAL FIELD

This invention relates generally to guns and projectile launchers and more particularly to electromagnetic projectile launchers which utilize superconducting armatures.

BACKGROUND OF THE INVENTION

Conventional guns and projectile launching weapons utilize the burning of chemical propellants to achieve high projectile velocities. In recent years, there has been a renewed interest in projectile launchers which utilize electromagnetic energy. Such electromagnetic launchers may find application in space launch weaponry and impact fusion as well as in more conventional ordnance. Generally speaking, electromagnetic launchers promise greater projectile velocities than launchers utilizing chemical propellants.

In electromagnetic launchers (also called railgun) large current pulses are introduced into current-carrying rail conductors to accelerate a projectile (often termed an armature).

An example of a novel railgun design together with a discussion of its operational principles and prior art, is contained in applicant's co-pending application entitled "Electromagnetic Injector/Railgun," Ser. No. 910,915, now abandoned, filed Sept. 22, 1986, the entire disclosure of which is hereby incorporated by reference.

In general, in railgun applications, armature velocity increases with increasing current. However, the magnitude cannot be increased without limit due to joule heating of the rails, together with radiative heating of the railgun materials by plasmas, and the structural loading on the rails created by high magnetic pressures. Joule heating of the rails is most severe when a fast-moving armature exposes new conductor material to intense currents which do not have time to diffuse into the body of the conductor. The joule heating effect predominates at the armature-rail interface. The joule heating effect causes severe rail erosion.

The rail erosion problem is perhaps the most serious technical problem which must be overcome before railguns can compete with conventional chemical propellant guns. Short rail operating life and low firing rate are detrimental characteristics of todays railguns.

Recent developments in the field of superconductivity have produced a variety of new ceramic-type materials which are capable of achieving the superconducting state at critical temperatures above 77° K., the boiling point of liquid nitrogen. The critical temperature is the temperature at which the material becomes superconducting. The new class of materials (termed for convenience "superconducting ceramics" herein—even for materials which are not basically ceramic in nature) have been extensively discussed in the popular press. For example, the New York Times, on Mar. 20, 1987, reported the existence of superconducting ceramics and described the making of such materials into sheets of vinyl-like tapes and washer shapes. Furthermore, *Electronics* in its Apr. 2, 1987 issue on pp 49–51 reported the making of superconducting ceramics into wire shapes.

The composition and manufacture of superconducting ceramics is discussed, for example, in *Physics Today* pp 17–23, April 1987 which is incorporated herein by reference. An entire class of compounds with the chemical composition are $RBa_2Cu_3O_{9-y}$, where R stands for a transition material or a rare earth ion and Y is a number less than 9, preferably $2.1\pm0.05$ has demonstrated superconductive properties above 90° K. This class of materials is included in the terms "superconducting ceramic" and "rare earth doped copper oxide" as used herein. Scandium, lanthanum, neodymium, samarium, europium, gadolinium, dysprosium, holmium, erbium, ytterbium, yttrium, and lutetium are acceptable substitutes for R above. The crystal structure of these compounds is described as an orthorhombically distorted perovskite structure.

Fabrication of superconducting ceramics is discussed in the above-mentioned *Physics Today* article. A detailed discussion of the fabrication and physical properties of a typical superconducting ceramic is also found in "R. J. Cava et al.," Bulk Superconductivity at 91° K. in Single Phase Oxygen-Deficient Perovskite $Ba_2YCu_3O_{9-\delta}$, *Physical Review* letters, pp 1676–1679, 20 April Vol. 58, No. 16.

Superconducting ceramics with high critical current densities (in excess of $10^5$ A/cm$^2$) may be produced by growing epitaxial films of $RBa_2Cu_3O_{7-x}$ on $SrTiO_3$ substrates as taught in P. Chaudhari et al., "Critical Current Measurements in Epitaxial Films of $YBa_2Cu_3O_{7-x}$ Compound," Phys. Rev. Ltrs. vol. 58, No. 25, pp 2684–2686, June 22, 1987.

Another recently discovered high temperature superconductor is: $BiBaCaCu_2O_4$. Is has been reported that the aforementioned compound becomes superconducting at temperatures over 110° K.

The attractiveness of high temperature superconductors is enhanced by the advent of miniature open cycle Joule-Thomson coolers. In a Joule-Thomson cooler, a fluid at high pressure is allowed to flow through a flow restrictor into a region of low pressure where it expands and cools in the process. Usually, the cooling fluid is high pressure argon or nitrogen. The new Joule-Thomson coolers are very compact, being 0.4" diameter and 2" long. Approximately 6 seconds is required to cool a 2–4 gram mass of high temperature superconductor from room temperature to below 80° K. The weight of the gas bottle is approximately 10 lbs. It is expected that a typical Joule-Thomson cooler is capable of cooling approximately 100 small armatures.

Those concerned with the development of electromagnetic launchers have engaged in a continual search to eliminate the problems of arcing and attendant rail erosion. The new superconducting ceramics offer potential solutions to these problems.

SUMMARY OF THE INVENTION

It is an object of the present invention to provide an electromagnetic projectile launcher capable of achieving ultra high projectile velocities.

It is another object of the present invention to provide an electromagnetic launcher with minimal Joule heating losses.

A further object of the present invention is to provide an electromagnetic launcher which is not susceptible to arcing or rail erosion.

The present invention utilizes an armature made from a superconducting material. In a preferred embodiment, the armature is made from one of the newly discovered high-temperature superconductors.

The armature has a loop topology. A persistent supercurrent is induced into the armature loop by cooling the armature below its critical temperature and exposing it to a magnetic field.

The launcher has two parallel rails energized by a dc current at the launch point and electrically connected at the muzzle end. Interaction between the supercurrent in the armature and the magnetic field caused by the dc current flowing through the connected rails causes levitation of the armature. There is no electrical contact between the armature and the rails—hence no possibility of arcing or rail erosion.

The armature is propelled between the rails by the Lorentz force created by interaction between the magnetic field of the rails and the supercurrent of the armature. The armature's geometry removes a portion of the supercurrent loop from the plane of the rails and thus allows a net Lorenz force to propel the armature between the rails and ultimately away from the muzzle of the launcher toward a target.

BRIEF DESCRIPTION OF THE DRAWINGS

Further objects and advantages of the present invention will become apparent to those familiar with the art upon examination of the following detailed description and accompanying drawings in which.

DETAILED DESCRIPTION OF THE PREFERRED EMBODIMENTS

Figure 1:
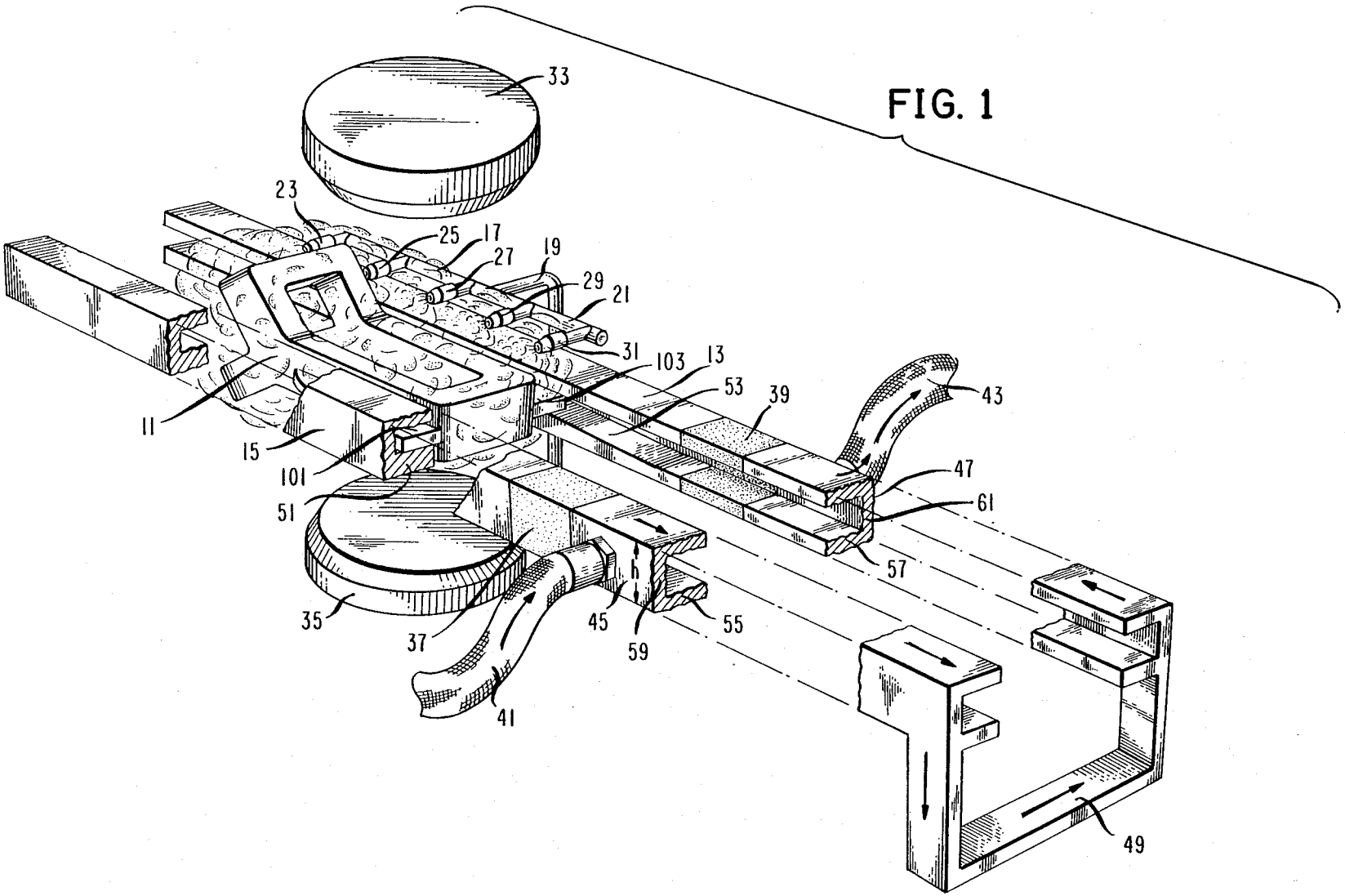
FIG. 1 is a perspective view of the inventive armature and a launcher system adapted to propel it.

In FIG. 1 reference numeral 11 indicates the inventive armature. Details of its construction and alternative designs will be presented later. The armature is supported by two rails 13 and 15. The rails may be made from metal or from insulating material. Fins 101 and 103 on armature 11 are supported by ramps 51 and 53 of rails 15 and 13 respectively. Pipe 19 carries refrigerating gas from a source not shown to manifold 21 and thence to nozzles 23, 25, 27, 29, and 31. Nozzles 23–31 spray coolant gas from a Joule-Thomson refrigerating element upon armature 11. The gas cools armature 11 to the superconducting state. Pole pieces 33 and 35 create a magnetic field in the region of armature 11. The balance of the magnet construction supporting pole pieces 33 and 35 is not shown for simplicity.

Figure 2:
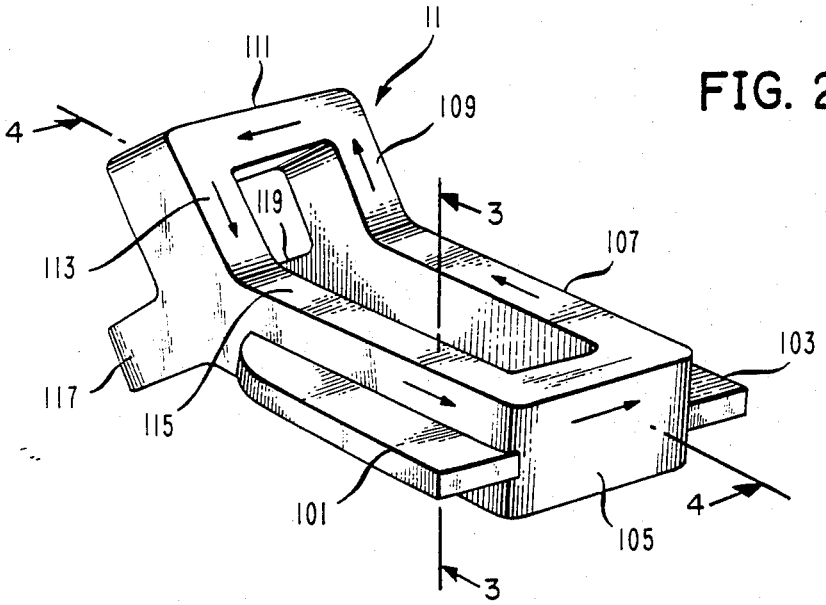
FIG. 2 is a perspective view of the armature alone.

When armature 11 is cooled to a temperature below its critical temperature (approximately 91° K. if armature 11 is made from a new superconducting material) and to a temperature below its field produced between pole pieces 33 and 35, armature 11 will have a superconducting current induced within it. Referring briefly to FIG. 2, the superconducting current travels through sides 105, 107, 109, 111, 113 and 115 of armature 11. More details about current flow through armature 11 will be provided subsequently. Returning now to FIG. 1, after the supercurrent has been induced in armature 11, the armature may be pushed by pneumatic or mechanical means along rails 15 and 13 onto rails 45 and 47. Rails 45 and 47 are made from metal or any other excellent conductor of electricity including superconducting material encased with metal for mechanical strength. Rails 45 and 47 may be separated by insulating segments 37 and 39 from rails 15 and 13 should the latter pair of rails be made of metal. If rails 15 and 13 are made from insulating material, there is, of course, no need for insulating segments 37 and 39.

Cables 41 and 43 are connected to a dc power source not shown. Conductive connector 49 connects the muzzle ends of rails 45 and 47. Connector 49 is shown as a solid metallic bar. However, a cable or any other means of short circuiting the muzzle ends of rails 45 and 47 is acceptable. Thus, when the non-illustrated power source is connected to cables 41 and 43, current flows, for example, from cable 41 through rail 45, through connector 49 thence through rails 47 and cable 43. (Current may flow in the reverse direction if polarity is reversed). The non-illustrated power source may be a battery-capacitor bank or a homopolar generator or a compulsator, etc. The lengths of rails 45 and 47 depend on the desired armature velocity. The longer the rails the faster the armature will travel. Rails 45 and 47 may be constructed of superconducting materials encased in a thin layer of a good conducting material. Means for cooling rails 45 and 47 may be utilized such as a tubing positioned interior to the super-conducting material which allows liquid nitrogen to flow through the tubing and hence cooling rails below the critical temperature. The joule heating of the rails can thus be eliminated.

As soon as a supercurrent is induced in armature 11, the device is ready for firing. Armature 11 is moved by mechanical or pneumatic means not illustrated to a point slightly past the point at which cables 41 and 43 join rails 45 and 47. Interaction between the magnetic field generated by the current flowing through rails 45 and 47 and the induced supercurrent in armature 11 causes armature 11 to levitate between rails 45 and 47 and accelerate towards the muzzle-end of rails 45 and 47.

Although armature 11 is not subjected to cooling gases during its traverse between rails 45 and 47, it will remain in the superconducting state for several seconds—far longer than the time needed for it to reach the muzzle end of rails 45 and 47.

Current flow through rails 45 and 47 may be controlled by a switch located within either cable 41 or 43 and not shown in the illustration. This switch enables the rails to be energized at the moment that armature 11 arrives in firing position. It should be noted that ramps 55 and 57 of rails 45 and 47 respectively are somewhat thinner than ramps 51 and 53 of rails 15 and 13 respectively. As soon as current is switched on in rails 45 and 47 the magnetic flux generated by the magnetic field created by the current flowing in rails 45 and 47 is expelled due to the Meissner effect from armature 11. Therefore there is no need to support armature 11 through fins 101 and 103. Grooves 59 and 61 (of which ramps 55 and 57 define a portion) merely serve to surround fins 101 and 103 and provide gentle guidance for armature 11 as it travels between rails 45 and 47.

Figure 3:
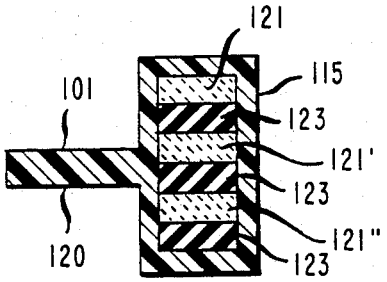
FIGS. 3 and 4 are cross sectional views of the armature illustrated in FIG. 2.
Figure 4:
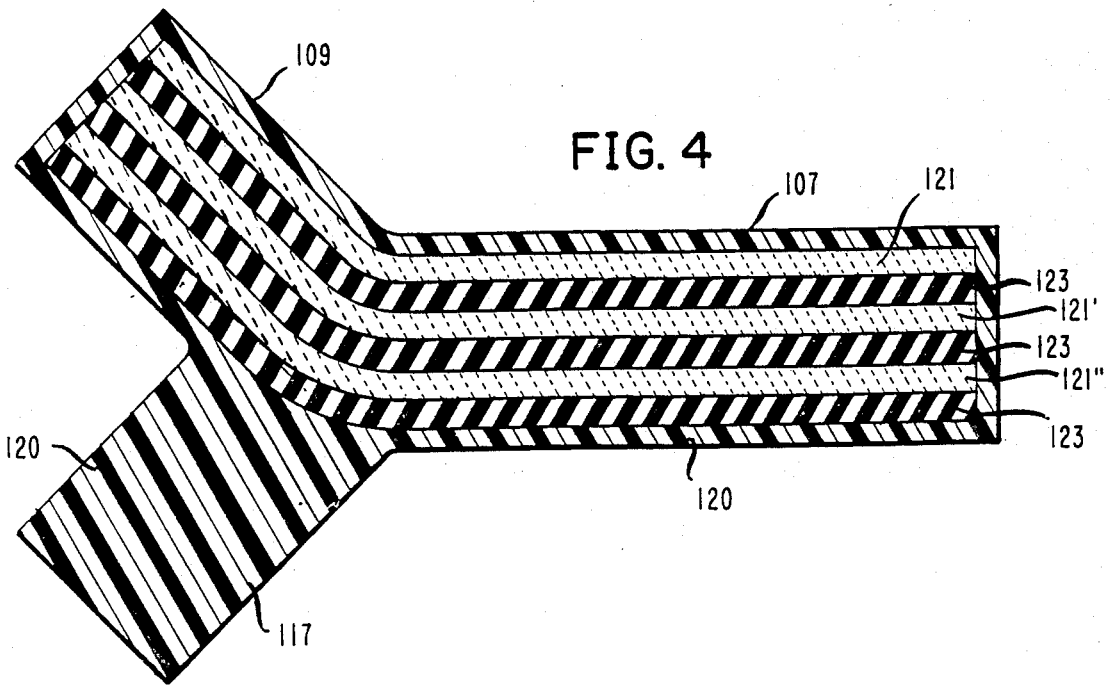

Turning now to FIGS. 2–4, the construction of armature 11 will be examined in detail. The entire outer surface of armature 11 is covered with low temperature epoxy 120 (illustrated in FIGS. 3 and 4). Fins 101 and 103 which merely serve to stabilize armature 11 as it traverses between rails 13, 15, 45, and 47 may be made entirely of epoxy 120. As mentioned before, the induced supercurrent flows through sides 105, 107, 109, 111, 113, and 115 of armature 11.

FIGS. 3 and 4 illustrate cross sections of the aforementioned conductive path. Examination of FIGS. 3 and 4 shows that the interior of armature 11 has alternating layers of superconducting ceramic 121 grown upon suitable substrates 123 such as strontium titanate. As mentioned before, high current densities are achievable in superconducting ceramic materials epitaxially grown upon substrates such as strontium titanate. Thus, the aforementioned current path has, as illustrated in FIG. 3, three separate closed superconducting paths indicated by reference numerals 121, 121', and 121''. Only three superconducting layers are shown for convenience, although the armature 11 may be built from tens or hundreds of such superconducting layers, each layer grown upon its corresponding substrate. If necessary, each superconducting layer may be separated from the substrate of the succeeding layer by insulating material.

As mentioned before, the entire armature 11 is encased in low temperature epoxy 120. Projections 117 and 119 are, as illustrated in FIG. 4, made entirely of epoxy. They are joined by an arm not shown in the figure to form a loop similar to that illustrated by arms 109, 111, and 113. Arms 117 and 119 merely serve to help stabilize armature 11 and they may be eliminated if desired.

Various methods are well known for depositing thin film superconducting ceramics. Laser ablation, plasma spraying, electron-beam deposition, sputtering, lithography, ion milling, etching, ion implantation and molecular beam epitaxy are some common methods that are utilized. The low temperature epoxy 120 prevents the superconducting ceramic from developing cracks and shattering and serves to electrically isolate the armature 11 from rails 45 and 47. Note, a metal may also be used to ensure the superconducting ceramic since the armature is isolated from the rails by fins 101 and 103.

It should be noted, with reference to FIG. 2, that arms 105, 107, and 115 of armature 11 serve to define current path(s) that are essentially in the plane of rails 45 and 47 However, arms 109, 111 and 113 provide a current path which is oblique to the plane defined by rails 45 and 47. Arms 109, 111 and 113 are tilted somewhat upward with respect to arms 105, 107, and 115. Arms 109, 111 and 113 may be tilted 90°, if desired). The same current travels through all arms of armature 11. However, since arm 111 is tilted somewhat out of the plane defined by rails 45 and 47, the Lorentz force which serves to propel armature 11 forward is greater than the Lorentz force which serves to retard armature 11. Consequently, the presence of a net unbalanced force upon armature 11 causes its acceleration between rails 45 and 47.

The Lorentz force which serves to propel armature 11 will now be examined in more detail. For proper operation, it is necessary that the polarity of the magnetic field generated between pole pieces 33 and 35 and the dc voltage applied to cables 41 and 43 be coordinated so that the current flowing in arm 115 of armature 11 is in the same direction as the current flowing in rail 45. The arrows in FIGS. 1 and 2 provide a convenient illustration of the desired current flow directions in this example. (Of course, reversal of both the current flow in armature 111 and rails 45 and 47 is also acceptable. What is important, however, is that the relative directions of current flow to be described below be maintained). The current in arm 107 flows in the same direction as the current rail 47. The current in arm 105 is perpendicular to and in the same plane as the currents traveling in rails 45 and 47. Thus, there is a net Lorentz force acting upon arm 105 of armature 11. If arm 111 of armature 11 were in the same plane as arm 105, an equal and opposite Lorentz force would act upon arm 111 and armature 11 would not move. However, because arm 111 is not in the same plane as arm 105 and rails 45 and 47, the Lorentz force acting upon arm 111 is less than the Lorentz acting upon arm 105. Consequently, here is a net force acting upon armature 11 tending to propel it towards the muzzle end of rails 45 and 47. In general, the magnetic field between rails 45 and 47 decreases in amplitude by the inverse of the distance squared ($1/R^2$) from the rails surfaces. Arm 111 of armature 11 should be out of the plane of the rails by at least two rail heights (2h) so that the Lorentz force on the current in arm 105 is at least 10 times greater than the Lorentz force on the current in arm 111. To create the Lorentz force on armature 11, the current flowing through the armature must essentially be perpendicular to the magnetic fields. The Lorentz force is given by $Idl \times B$. As already illustrated, the Idl current and the current that generates the magnetic field B need not be produced from the same power source.

Figure 5:
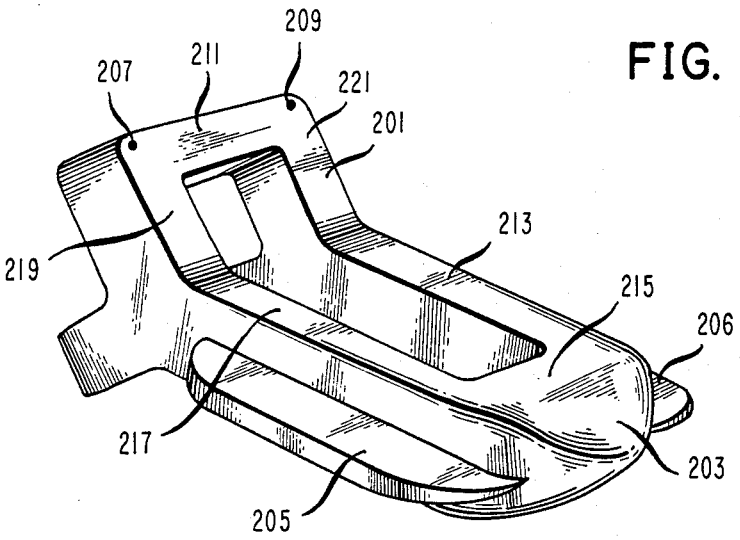
FIGS. 5–7 are perspective view of alternative embodiments of the inventive armature
Figure 6:
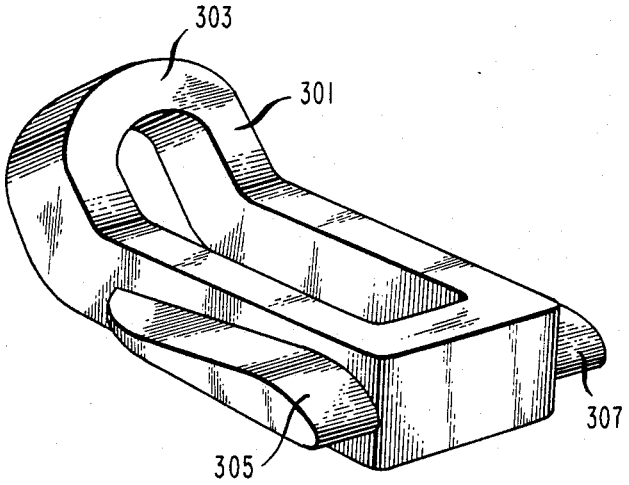
Figure 7:
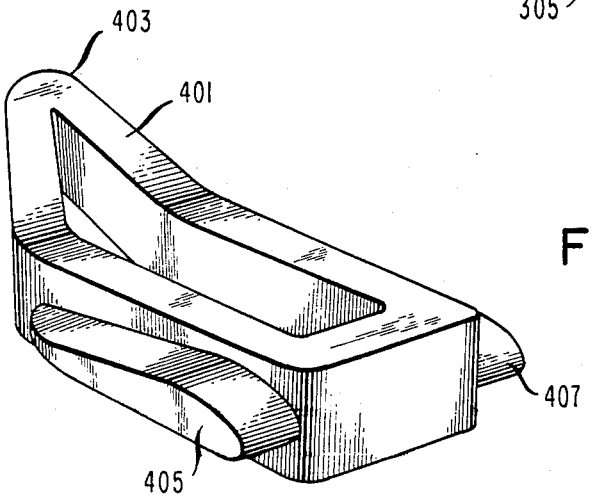

Keeping in mind that an armature with current paths which are in and out of the plane defined by rails 45 and 47 receives a net unbalanced Lorentz force and is therefore accelerated, the alternative armature embodiments illustrated in FIGS. 5–7 may be understood. In FIG. 5, armature 201 has an aerodynamic nose 203 and fins 205 and 206 which are tapered toward nose 203. Current flows through arms 215, 213, 221, 211, 219, and 217. Arc 211, is of course, out of the plane of rails 45 and 47.

An alternative method of inducing a persistent supercurrent in armature 201 will also be mentioned here. The magnet represented by pole pieces 33 and 35 may be eliminated. A supercurrent may be induced into armature 201 by applying a source of dc voltage to two points on armature 201. Of course, if armature 201 is made from multiple layers of superconducting ceramic, such as illustrated in FIGS. 3–4, a plurality of dc contacts may be necessary. As armature 201 is chilled by gas emanating from nozzles 23–31, a laser (not shown) is directed upon one of the arms of armature 201, for example, arm 211. The laser causes localized heating, forms a shunt with the power supply and allows current to flow on all the arms of the armature except the arm that is heated and back through the power supply. When the laser is removed, a complete or closed circuit path is formed in the armature and a supercurrent flows in the armature. The armature 01 may then be moved by mechanical or pneumatic means into firing position.

FIG. 6 illustrates another embodiment of the armature of the present invention. Armature 301 contains loop 303 which is out of the plane of rails 45 and 47. Fins 305 and 307 are airfoil-shaped to improve flight characteristics of armature 301. There is no lower loop corresponding to arms 117, 119 and their unshown connecting arm in FIG. 2. Arm 303 of armature 301 is curved as opposed to straight arms 211 and 111 shown in FIGS. 5 and 2 respectively. In FIG. 7 armature 401 has a pointed out-of-the plane current path 403 and aerodynamic fins 405 and 407 Each of the armatures illustrated in FIGS. 5–7 may be constructed from multiple alternating layers of superconducting ceramic and substrate. All of the armatures illustrated in FIGS. 5–7 should also be coated with epoxy or similar non-conducting material to prevent electrical contact between their outer surfaces and rails 45 and 47. Also, the fins may be made of non-conducting material to isolate the armature from rails 45 and 47 which then allows the armature to be coated with a metal.

The illustrative embodiments herein are merely a few of those possible variations which will occur to those skilled in the art while using the inventive principles contained herein. Accordingly, numerous variations of invention are possible while staying within the spirit and scope of the invention as define in the following claims and their legal equivalents.

What is claimed is:

1. An electromagnetic weapon comprising:

an armature having first and second parallel arms, a third arm connecting said first and second arms, said first, second and third arms defining a first plane, fourth and fifth arms connected to said first and second arms respectively, said fourth and fifth arms defining a second plane which is oblique to said first plane, a sixth arm connected between said fourth and fifth arms; first and second stabilizing fins attached to said first and second arms respectively;

first and second parallel rails spaced apart to receive said first and second arms of said armature;

means for producing a magnetic field perpendicular to said first plane;

means for cooling said armature;

means for applying a voltage to said first and second rails whereby said armature accelerates between said rails and is ejected towards a chosen target.

2. An electromagnetic weapon for launching an armature comprising:

a pair of first and second conducting rails spaced a parallel predetermined distance apart and connected by a third conducting rail;

said first and second rails having internal grooves for guidance of said armature;

said armature being disposed between said pair of conducting rails and having parallel first and second arms connected by a third arm all within the same plane;

said armature comprising parallel fourth and fifth arms connected by a sixth arm all oblique to and out of said plane of first, second and third arms;

a set of stabilizing fins on said first and second arms of said armature;

said armature being comprised of superconducting material;

means for creating a first magnetic field in the region of said armature, said means being positioned on either side of said armature;

means for cooling said armature so that a superconducting current is induced within said armature when subjected to said magnetic field; and means for applying a voltage across the first and second conducting rails so that a second magnetic field is created which interacts with said superconducting current in said armature producing acceleration of said armature along and then away from said rails.

3. An electromagnetic weapon for launching an armature as defined in claim 2 wherein said stabilizing fins are respectively disposed in said grooves of said first and second rails.

4. An electromagnetic weapon for launching an armature as defined in claim 3 wherein said first and second rails are open at one end to permit the passage of said armature away from said first and second rails.

* * * * *